United States Patent [19]

Ruud et al.

[11] Patent Number: 4,689,729

[45] Date of Patent: Aug. 25, 1987

[54] FLOODLIGHT

[75] Inventors: Alan J. Ruud, Sturtevant; Donald Wandler, Racine, both of Wis.

[73] Assignee: Ruud Lighting, Sturtevant, Wis.

[21] Appl. No.: 854,094

[22] Filed: Apr. 21, 1986

[51] Int. Cl.[4] ..... F21V 29/00

[52] U.S. Cl. ..... 362/375

[58] Field of Search ..... 362/375, 364, 267, 370, 362/371

[56] References Cited

U.S. PATENT DOCUMENTS

| | | | |
|---|---|---|---|
| 2,120,449 | 6/1938 | Vanderveld | 362/375 |
| 2,701,840 | 2/1955 | Carlson | 362/375 |
| 3,983,387 | 9/1976 | Van Steenhoven et al. | 362/375 |
| 4,255,781 | 3/1981 | Plemmons et al. | 362/375 |
| 4,410,931 | 10/1983 | De Candia et al. | 362/375 |
| 4,432,045 | 2/1984 | Merritt | 362/375 |
| 4,434,456 | 2/1984 | Taylor | 362/375 |
| 4,509,106 | 4/1985 | Mayer et al. | 362/375 |
| 4,538,217 | 8/1985 | Ewing et al. | 362/375 |

*Primary Examiner*—Raymond A. Nelli

*Attorney, Agent, or Firm*—Peter N. Jansson

[57] ABSTRACT

A floodlight having a housing with a lateral wall forming an access opening, an access door which when closed is recessed within the housing, and articulated hinges which extend between the interior surface of the lateral wall and the inside surface of the door.

17 Claims, 16 Drawing Figures

FLOODLIGHT

FIELD OF THE INVENTION

This invention is related generally to floodlights and, more particularly, to floodlights of the type having a housing with an access opening and a hinged access door with the light-emitting pane.

BACKGROUND OF THE INVENTION

A great variety of floodlights have been disclosed and used in the prior art. Many of these have housings which contain lamps and various other electrical components, and such housings often each have an access opening which is covered by a hinged, light-transmissive access door during use. This invention is particularly concerned with the relationship of the door to the housing in such floodlights.

Such floodlights of the prior art have a number of problems and deficiencies. When they are exposed to the weather during outdoor use, water often enters their housings even though the floodlights have seals and other means for preventing such water ingress. Another problem relates to the effects of weather on hinges connecting an access door to a floodlight housing and on seals. Over extended periods, exposure to the elements causes corrosion and malfunction of hinges which interfere with easy operation of the access door. Such hinge corrosion can make opening of the access door for servicing and later reclosing difficult.

Quite apart from problems caused by corrosion of hinges, regular servicing of certain floodlights of the prior art, such as replacing lamps, can often be difficult and time-consuming because of difficulty in gaining access to the inside of the housings. Such difficulty in gaining access is in part due to the fact that the floodlights are typically mounted high in the air, in an inconvenient location. But the difficulty also frequently comes from the fact that an excessive number of manipulative steps are necessary for opening and reclosing a floodlight access door. Sometimes, many connectors around the perimeter of the access door, used to obtain a good water-tight seal of the access door when it is closed, must be removed. If fewer connectors are used, resealing the housing may be less difficult, but water ingress more easily occurs.

Even when the access door is in an "open" position, with some floodlights of the prior art it remains difficult to conveniently reach into the housing for servicing. The position and/or orientation of the opened access door often interferes with easy access to inside the housing.

There is a need for an improved floodlight of the type having a hinged light-transmissive access door. There is a need for such a floodlight which is reliably and easily sealed against the ingress of water, and on which the hinges and seals are better protected against corrosion and degradation caused by the elements.

There is also a need for a floodlight of the type described which may easily be opened and closed for servicing, without the need for excessive manipulative steps, and which may be fully opened to allow convenient access to the inside of the housing. Finally, there is a need for an improved floodlight of the type described which may be easily opened without sacrificing resistance to water ingress when it is closed.

SUMMARY OF THE INVENTION

This invention is an improved floodlight of the type having a housing with an access opening and access door hinged to the housing to removably cover the access opening. The access door includes a light-transmissive member through which light is emitted from the floodlight.

The housing of the floodlight of this invention has a surrounding lateral wall which terminates in an edge forming the access opening. The access door has a perimeter with cross-dimensions less than the cross-dimensions of the access opening at the edge of the surrounding lateral wall, such that when the access door is closed it is nestled within the housing. That is, rather than overlapping the edge of the surrounding lateral wall, the access door is recessed into the access opening formed by the edge of the surrounding lateral housing wall. The recessed engagement of the access door with the housing when the door is closed has an advantage in protecting the seals between the door and housing from the most direct exposure to the elements.

Articulated hinge means, that is, hinges having multiple independent pivot points, extend between the interior surface of a first side portion of the surrounding lateral wall and the inside surface of the access door. Thus, when the access door is closed, the hinges are enclosed within the housing and protected by the housing from the elements. This reduces hinge corrosion and the resultant operational problems, and allows a great improvement in the appearance of the floodlight.

The articulated hinges, attached as described, also serve to allow the access door to be opened to a position completely away from the access opening, thus providing easy accessibility to the inside of the housing.

The articulated hinge means preferably includes a plurality of hinges spaced along the aforementioned first side portion of the lateral housing wall. Most preferably, there are a pair of hinges at opposite end of the first side portion.

Each hinge preferably includes a housing bracket secured to the interior surface of the first side portion of the lateral housing wall, a door bracket secured to the inside surface of the access door, and a link member joining the door bracket to the housing bracket. The housing bracket has a first pivot attachment means which is in fixed position with respect to the first side portion of the lateral housing wall. The door bracket has a second pivot attachment means which is in fixed position with respect to the door. The first and second pivot attachment means of each hinge are at first and second independent pivot points, respectively.

The link member is joined to the housing bracket and door bracket by two separate pivot attachments—one to each of the aforementioned first and second pivot attachment means. When the access door is closed, the second pivot attachment means is positioned offset from the first pivot attachment means in a direction away from the door. Thus, when the access door is closed the link member serves to hold the door firmly in its closed position against the housing.

The linkage member of each hinge is secured to a stabilizing bar which extends along the first pivot points of the hinges such that the linkage members pivot within the housing brackets in unison. This avoids binding during opening and closing of the door, thus eliminating a common problem in floodlights of this type.

In a preferred form, the door bracket is a generally L-shaped member. The door bracket may be described most easily when the door is in its closed position: The L-shaped member has a first portion extending away from the door and a second portion extending toward the interior surface of the lateral housing wall in a direction generally perpendicular to the first portion. The second portion has a distal end which includes the aforementioned second pivot attachment means. The link member is itself rigid, which enables it to hold the access door firmly against the housing when the door is in its closed position.

A resilient seal means is located between the access door and the housing when the access door is closed. More specifically, a seal means is located between the perimeter of the door and the interior surface of the lateral housing wall near the edge thereof. The dimensioning and positioning of the door, the housing, and the link member of the hinge cause the door perimeter to bear on the seal means when the door is closed, deforming it to improve resistance to water ingress.

The interior surface of the lateral housing wall has an outwardly-facing ridge surface extending thereabout near the edge of the surrounding lateral wall, and the inside surface of the door has inwardly-extending member near the door perimeter. The resilient seal means preferably comprises a ring seal extending along the perimeter of the access door against such inwardly-extending member and the inside surface of the door, in position to contact the aforementioned ridge surface when the door is closed.

The effective length of the link member, that is, the distance between the first and second pivot attachment means, is preferably greater than the distance between the first pivot attachment means, which is on the housing bracket, and the edge of the lateral wall of the housing. This facilitates removal of the door well away from the opening, to provide full opening and improved accessibility to the inside of the housing.

The access door of the floodlight of this invention preferably includes a frame which supports a light-transmissive member. Such frame has a proximal frame portion to which the hinges are connected and an opposite distal frame portion. The distal frame portion has connector means on it which form the sole means for detachably securing the door in the closed position against the housing wall. Using articulated hinges and a nestled relationship of access door to housing allows good sealing of the floodlight when the access door is closed without the necessity of several connectors at various locations around the door frame to secure the door to the housing. Connectors on the distal frame portion are sufficient for this purpose.

In preferred embodiments, the access opening and the access door frame are generally rectangular in shape. A pair of hinges are located one at each of two adjacent corners of such rectangle, and a pair of door-housing connectors are located at the opposite pair of adjacent corners of such rectangle. The door-housing connectors are preferably captive members which can be disengaged from the housing itself without disengagement from the door frame. This facilitates easy opening and reclosing of the floodlight for servicing.

In highly preferred embodiments, the edge of the surrounding lateral wall which forms the access opening in the housing is planar, and the access door itself is generally planar. This facilitates the nesting engagement of the access door with the housing. When the access door is closed, its outside surface is recessed with respect to the access opening. This configuration allows an attractive uncluttered appearance for the floodlight of this invention. More specifically, in viewing the floodlight from the side, the access door cannot be seen when it is closed. And, as earlier noted, the hinges and seal for such door cannot be seen.

The floodlight of this invention is highly resistant to water ingress, to corrosion of hinges, and early degradation of its seal. Furthermore, the floodlight of this invention may be easily opened and closed for normal maintenance and service, with a few simple manipulative steps. And, when opened, a full opening is provided which permits easy accessibility for service and maintenance.

OBJECTS OF THE INVENTION

It is an object of this invention to provide a floodlight overcoming some of the problems and shortcomings of devices of the prior art.

Another object of this invention is to provide a floodlight with a hinged door having good resistance to water ingress.

Another object of this invention is to provide a floodlight with a hinged access door in which the hinges are protected from corrosion and resulting malfunctions.

Another object of this invention is to provide a floodlight having an access door which may be easily opened with few manipulative steps.

Yet another object of this invention is to provide a floodlight having an access door which may be easily opened and reclosed and yet provide good resistance to water ingress.

These and other objects will be apparent from the following additional descriptions and from the drawings, wherein:

BRIEF DESCRIPTION OF THE DRAWINGS

FIGS. 4A–9A are enlarged, partially cutaway side elevations of the floodlight unit itself, illustrating the positions and orientations of various parts at different stages in the opening or closing of the access door.

FIGS. 4B–9B are fragmentary side elevations magnifying portions of FIGS. 4A–9A, respectively, with small portions (the door seal) shown in section.

DETAILED DESCRIPTION OF PREFERRED EMBODIMENT

Figure 1:
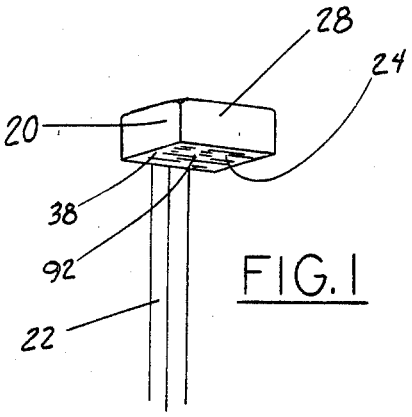
FIG. 1 is a perspective view of a floodlight in accordance with this invention, attached at the top of a mounting pole.

The figures show a floodlight 20 in accordance with this invention. In use, floodlight 20 is usually mounted atop a vertical mounting pole 22 with its light-emitting surface 24 facing in a generally downward direction. Floodlight 20 is secured to mounting pole 22 by a pivot mount 26, which allows floodlight 20 to be tilted, if such is desired.

Floodlight 20 includes a housing 28 which is generally rectangular in shape, with its sides perpendicular to each adjacent side. Housing 28 is preferably a seamless aluminum casting, having continuous lateral surrounding walls 30 which are integrally formed with one another and with a backplate 32. Lateral surrounding walls 30 terminate in a continuous edge 34 which forms an access opening 36 on the lower side of housing 28. Access opening 36 is the only opening in housing 28. All of edge 34 falls in a single plane, referred to herein as a light-emitting opening plane 38.

Not shown are various elements which are secured within housing 28, including a lamp socket and lamp, reflectors, a ballast, a capacitor, an ignitor, and various connecting wires. Satisfactory arrangements and attachments for such components would be apparent to those skilled in the art.

Figure 2:
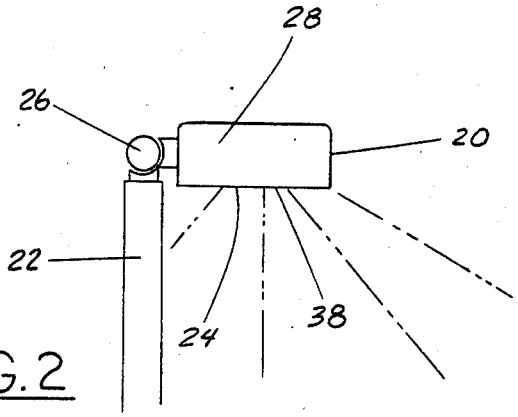
FIG. 2 is a side elevation of FIG. 1.
Figure 4B:
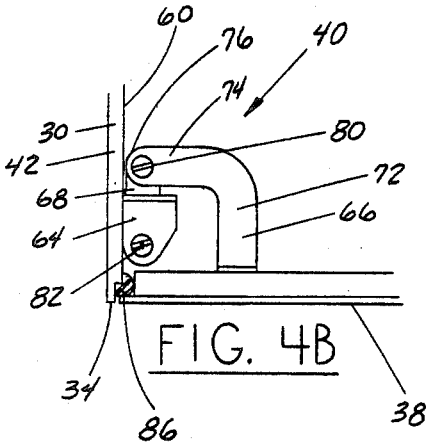
Figure 4A:
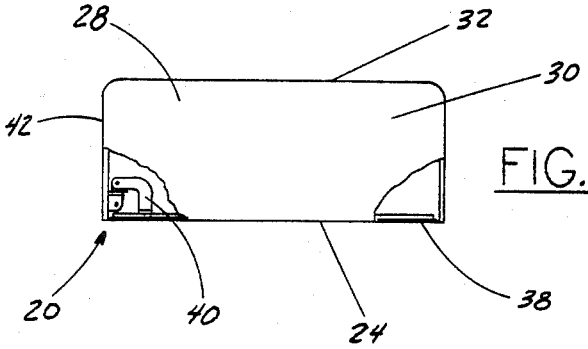
Figure 3:
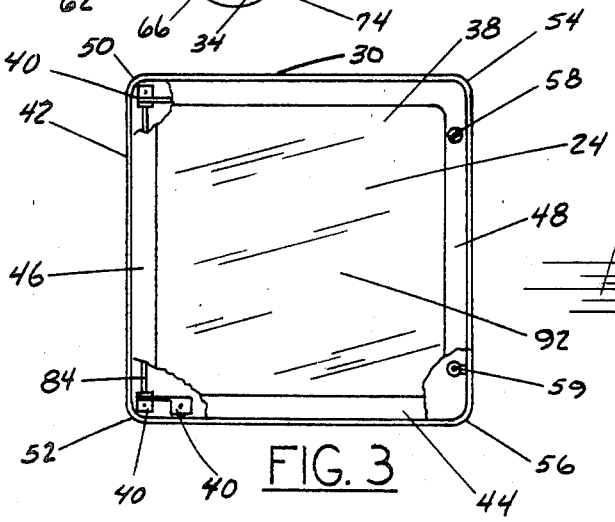
FIG. 3 is an enlarged, partially cutaway, fragmentary bottom plan view of FIG. 2, with the mounting pole removed.

Floodlight 20 includes an access door 38 which is attached to housing 28 by a pair of hinges 40. When floodlight 20 is closed, hinges 40 are entirely inside housing 28. For that reason, they are not seen in FIGS. 1 and 2, and are only seen in FIG. 3 by virtue of the cutaways in such figure. FIG. 3, however, is helpful in illustrating the general locations of the two hinges 40.

FIGS. 3, which shows the bottom face of floodlight 20, illustrates the similar shapes of access door 38 and access opening 36. Access opening 36, which is formed by edge 34 of lateral walls 30, is generally rectangular in shape, as is access door 38. The perimeter of access door 38 has cross-dimensions slightly less than the cross-dimensions of access opening 36. This allows door 38 to be nestled within access opening 36 when the door is closed.

Also as illustrated in FIG. 3, surrounding lateral wall 30 of housing 28 has a first side portion 42, and access door 38 has a frame 44 which includes a proximal frame portion 46 aligned with first side portion 42. The two hinges 40 interconnect first side portion 42 with proximal frame portion 46, one hinge being at either end of such aligned portions—at corners identified in FIG. 3 by the numerals 50 and 52.

The frame of access door 38 also includes a distal frame portion 48 which is opposite proximal frame portion 46. At opposite ends of distal frame portion 48 are connectors 58, which are used to detachably join access door 38 to housing 28 when the door is closed. Such connectors are at the corners identified in FIG. 3 by the numerals 54 and 56. Connectors 58 extend through distal frame portion 48 and into connector receptacles 59 (see FIG. 3) which are attached to interior surface 60 of lateral wall 30 inside housing 28. Connectors 58 are preferably captive screw members which will always remain attached to distal frame portion 48, but which when turned will be disconnected from connector receptacles 59. When connectors 58 are thus detached from connector receptacles 59, access door 38 can be swung open, as hereafter described.

As illustrated best in FIGS. 4B–9B, each of the two hinges 40 extend between interior surface 60 of the housing lateral wall 30 and access door 38. More specifically, each hinge 40 extends from interior surface 60 of first side portion 42 of housing lateral wall 30 and the inside surface 62 of access door 38. Not only is each hinge connected to housing 28 and access door 38 internally, but all parts of the hinges 40 are inside housing 28 when access door 38 is closed.

Each hinge 40 includes a housing bracket 64 rigidly affixed to interior surface 60 of housing wall 30, a door bracket 66 rigidly attached to inside surface 62 of access door 38, and a rigid link member which is pivotably attached to each of housing bracket 64 and door bracket 66.

Housing bracket 64 includes a hole (not directly shown) which forms a first pivot attachment means in fixed position with respect to first side portion 42 of housing wall 30. Door bracket 66 is a rigid generally L-shaped member having a first portion 72 which extends away from access door 38 and a second portion 74 which is generally perpendicular to first portion 72 and extends towards interior surface 60 of first side portion 42 of lateral housing wall 30. Second portion 74 of door bracket 66 has a distal end 76 which includes a hole (not directly shown) forming a second pivot attachment means in fixed position with respect to access door 38.

Link member 68 has separate pivot attachments, one at either end, to the holes in housing bracket 64 and door bracket 66. Bolt 80 extends freely through the hole in door bracket 66 and link member 68 is tapped to receive bolt 80 to a limited extent such that bolt 80 forms a pivot pin for door bracket 66. Likewise, bolt 82 extends freely through both housing bracket 64 and link member 68 and from there into threaded engagement with the end of a stabilizing rod 84 (see FIG. 3) which extends between the link members and housing brackets of the two hinges used in floodlight 20. Bolt 82 forms a pivot pin for free pivoting movement of link member 68 with respect to housing bracket 64. The two hinges 40 used in floodlight 20 are in axial alignment with one another.

FIGS. 4–9 illustrate the invention in various positions and orientations of use. FIGS. 4A and 4B show access door 38 and hinge 40 in closed condition. In such condition, link member 68 is parallel to interior surface 60 of housing lateral wall 30 and is perpendicular to access door 38. The second pivot attachment means, which is centered on bolt 80, is offset from the first pivot attachment means, which is centered on bolt 82, in a perpendicular direction with respect to access door 38. Thus, link member 68 serves to hold access door 38 in a position firmly against housing 28.

Figure 10:
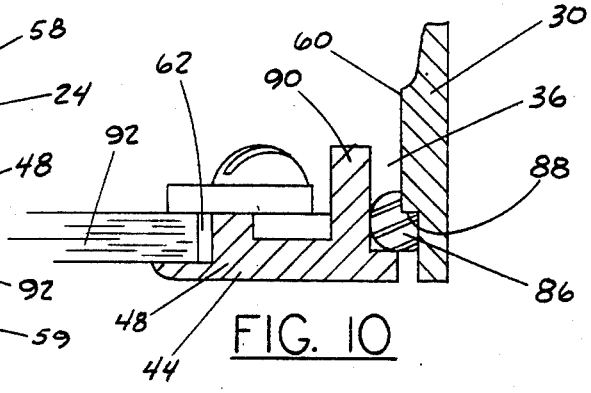
FIG. 10 is an enlarged fragmentary sectional view (without background), illustrating the door seal of the floodlight shown in the drawings.

As illustrated best in FIG. 10, a seal ring 86 which is between the perimeter of access door 38 and the edge of access opening 36 is somewhat deformed by virtue of the action of link member 68 in holding access door 38 against housing 28. This tends to improve the watertight closure of floodlight 20.

Interior surface 60 of housing lateral wall 30 has an outwardly-facing ridge surface 88 against which seal ring 86 bears when access door 38 is closed. Inside surface 62 of access door 38 has an inwardly-extending annular member 90 near the access door perimeter. Seal ring 86 is permanently attached to access door 38 along its perimeter and against inwardly-extending annular member 90, as shown in FIG. 10. This positions seal ring 86 for proper engagement with ridge surface 88, to help provide good sealing engagement of access door 38 with housing 28. Seal ring 86 extends continuously around access door 38, but in FIGS. 4B–9B is shown in section for clarity.

Figure 5B:
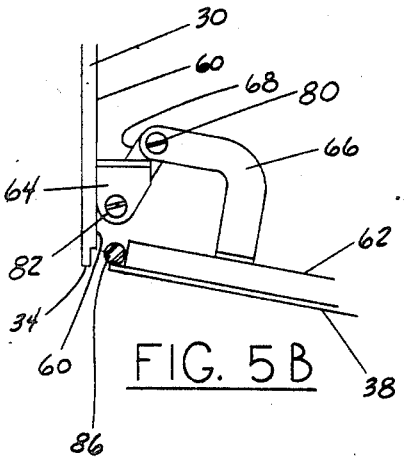
Figure 5A:
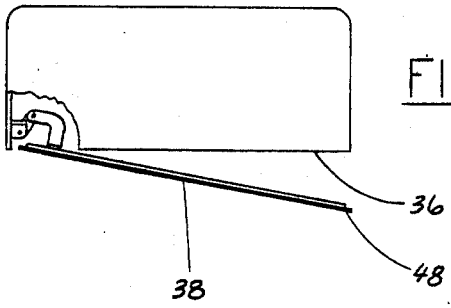

To open access door 38, the two connectors 58 are turned to disengage them from their connector receptacles 59 on housing 28. FIGS. 5A and 5B illustrate the initial opening movements of access door 38 and hinges 40. Distal frame portion 48 is pulled away from access opening 36 in an initial opening movement. Initial pivoting of hinges 40 occurs about the pivot axis formed by bolt 80—between door bracket 66 and link member 68. As such initial opening movement continues, some pivoting occurs about the pivot axis formed by bolt 82—between link member 68 and housing bracket 64.

Figure 6B:
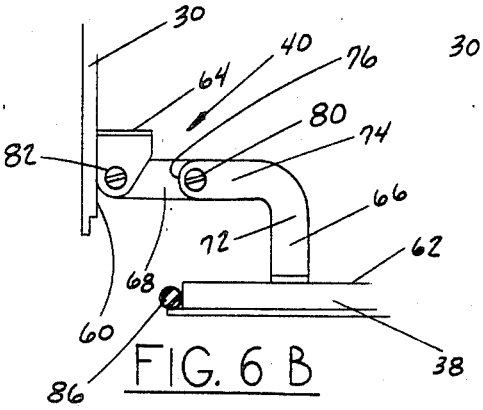
Figure 6A:
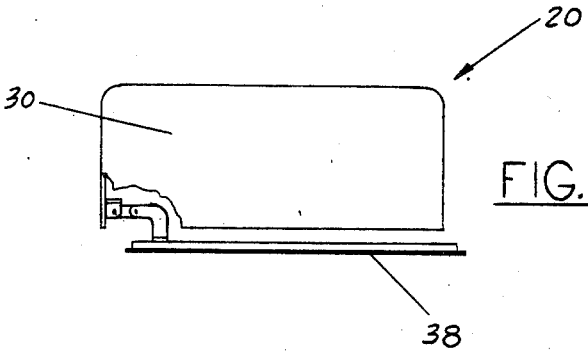
Figure 7B:
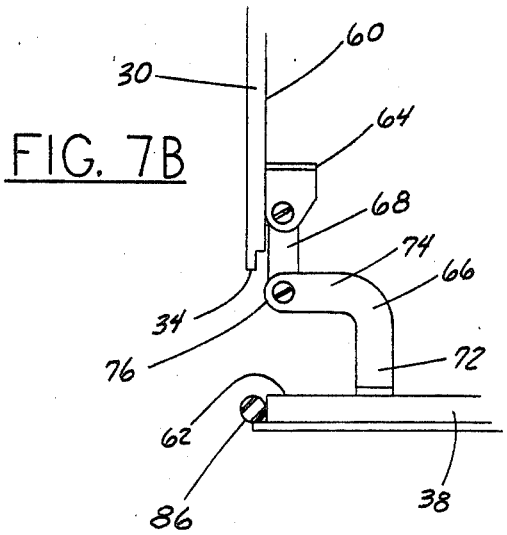
Figure 7A:
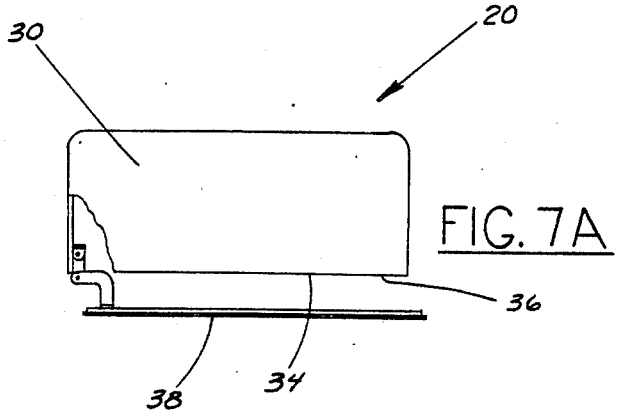

FIGS. 6A and 6B show a subsequent position during the opening of access door 38. Both of the pivot points on each of the hinges 40 continue to have similar pivoting movement. In FIGS. 7A and 7B, link member 66 has moved to a position 180 degrees from its starting position, and is again substantially parallel to housing lateral wall 30. The relative positions of door bracket 66 and link member 68 have also changed; some reverse pivoting movement has accommodated the movement of link member 68 to its new position. Access door 38 is substantially parallel to access opening 36, but is well removed from engagement therewith.

Figure 8A:
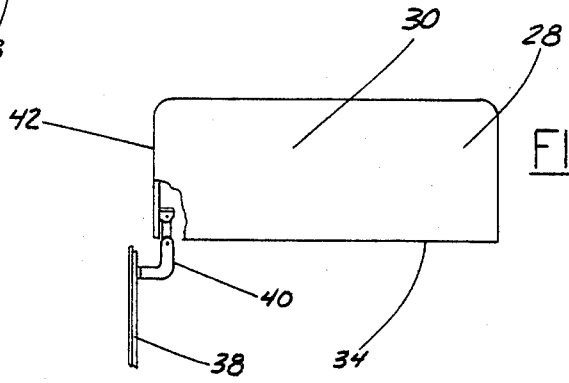
Figure 8B:
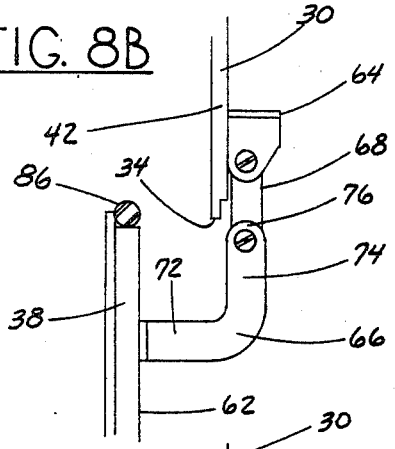
Figure 9A:
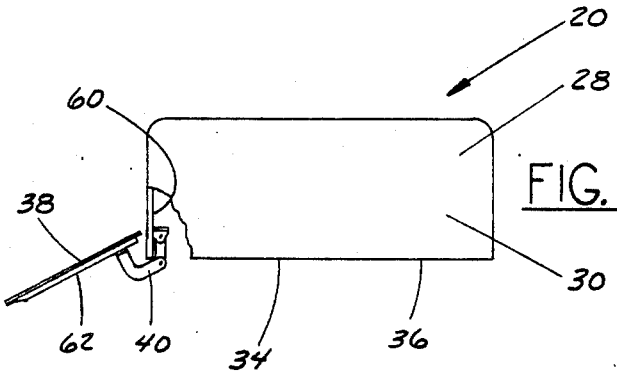
Figure 9B:
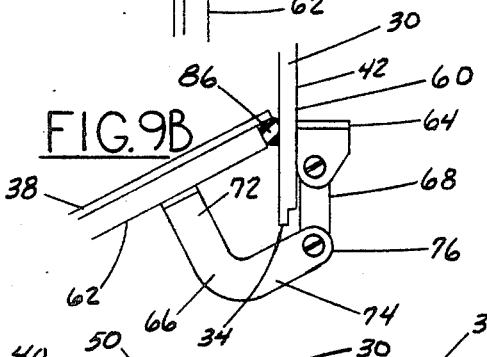

FIGS. 8A and 8B illustrate access door 38 in a removed position generally perpendicular to the plane formed by access opening 36. This has been accomplished by further relative pivoting movement between door bracket 66 and link member 68. FIGS. 9A and 9B illustrate the full open position of access door 38, which is reached by continued rotation of door bracket 66 with respect to link member 68.

In the fully-open position shown in FIGS. 9A and 9B, floodlight 20 may easily be serviced. Access door 38 is completely out of the way. The fully opened position also may be utilized to advantage during assembly and initial testing of floodlight 20.

As shown best in FIGS. 7B–9B, link member 66 is of greater length, between its separate pivot attachments, than the distance between its pivot attachment to housing bracket 64 (at bolt 82) and edge 34 of housing lateral wall 30. This facilitates removal of access door 38 well away from access opening 36.

As shown in FIGS. 1, 3 and 10, access door 38 includes a light-transmissive glass pane 92. FIG. 10 illustrates the manner in which glass pane 92 is secured to inside surface 62 of the frame of access door 38.

Floodlight 20 may be made using materials and components which are well known to those skilled in the art. Hinges 40 may be made of stainless steel or aluminum members, or using a variety of other materials.

While the principles of this invention have been described in connection with specific embodiments, it should be understood clearly that these descriptions are made only by way of example and are not intended to limit the scope of the invention.

What is claimed:

1. In a floodlight of the type having a housing with an access opening and an access door, the improvement comprising:

the housing having a surrounding lateral wall with interior and exterior surfaces and terminating in an edge which forms the opening, said lateral wall including a first side portion defining a reference plane;

the access door having inside and outside surfaces and a perimeter with cross-dimensions less than the distances between the opposed interior surfaces at the opening such that when the door is closed the perimeter is spaced inwardly from the interior surfaces and recessed from the edge to avoid water ingress;

at least two articulated hinges each extending between the interior surface of the housing first side portion and the inside surface of the door and each having first and second independent pivot points fixed with respect to the housing and door, respectively, and linkage means therebetween, the hinges positioned and arranged so that the door when opened may be moved to a position on the exterior side of the reference plane completely away from the opening; and the linkage means of each hinge secured to a stabilizing bar extending along the first pivot points for unison motion to avoid binding during opening and closing.

2. The floodlight of claim 1 wherein the articulated hinges each comprise:

a housing bracket secured to the interior surface of the first side portion and having a first pivot attachment means at said first pivot point;

a door bracket secured to the inside surface of the door and having a second pivot attachment means at said second pivot point; and said linkage means comprising a link member having separate pivot attachments to the first and second pivot attachment means, the second pivot attachment means, when the door is closed, being offset from the first in a direction away from and normal to the door whereby the link member holds the door firmly against the housing.

3. The floodlight of claim 2 wherein the door bracket is a rigid generally L-shaped member such that, when the door is in closed position, the L-shaped member has a first portion extending away from the door and a second portion extending toward the interior surface and having a distal end including the second pivot attachment means.

4. The floodlight of claim 1 further comprising resilient seal means located, when the door is closed, between the perimeter of the door and the interior surface near the edge, said perimeter, housing and seal being positioned and arranged such that on inward movement the door bears only on the seal means.

5. The floodlight of claim 4 wherein the interior surface has a outwardly-facing ridge surface thereabout near the edge and the inside surface of the door has an inwardly-extending member near the perimeter, the resilient seal means comprising a ring seal extending along the perimeter against the inwardly-extending member and the inside surface, in position to contact the ridge surface when the door is closed.

6. The floodlight of claim 5 wherein the articulated hinges each comprise:

a housing bracket secured to the interior surface of the first side portion and having a first pivot attachment means at said first pivot point;

a door bracket secured to the inside surface of the door and having a second pivot attachment means at said second pivot point; and said linkage means comprising a link member having separate pivot attachments to the first and second pivot attachment means, the second pivot attachment means, when the door is closed, being offset from the first in a direction away from and normal to the door whereby the link member holds the door firmly against the housing.

7. The floodlight of claim 2 wherein the length of the link member, between the separate pivot attachments, is greater than the distance between the first pivot attachment means on the housing bracket and the edge of the lateral wall of the housing, to facilitate removal of the door from the opening.

8. The floodlight of claim 1 wherein the access door includes a frame supporting a light-transmissive member, the frame having a proximal frame portion to which the hinge means is connected and an opposite distal frame portion having connector means thereon which are the sole means for detachably securing the door in the closed position against the lateral wall.

9. The floodlight of claim 8 wherein the articulated hinges each comprise:

a housing bracket secured to the interior surface of the first side portion and having a first pivot attachment means at said first pivot point;

a door bracket secured to the inside surface of the door and having a second pivot attachment means at said second pivot point; and said linkage means comprising a link member having separate pivot attachements to the first and second pivot attachment means, the second pivot attachment means, when the door is closed, being offset from the first in a direction away from and normal to the door whereby the link member holds the door firmly against the housing.

10. The floodlight of claim 9 wherein the door bracket is a rigid generally L-shaped member such that, when the door is in closed position, the L-shaped member has a first portion extending away from the door and a second portion extending toward the interior surface and having a distal end including the second pivot attachment means.

11. The floodlight of claim 10 further comprising resilient seal means located, when the door is closed, between the perimeter of the door and the interior surface near the edge, the second pivot attachment means being offset from the first by a distance such that the link member holds the door in position against the seal deforming the seal to obtain an improved watertight closure.

12. The floodlight of claim 11 wherein the interior surface has a outwardly-facing ridge surface thereabout near the edge and the inside surface of the door has an inwardly-extending member near the perimeter, the resilient seal means comprising a ring seal extending along the perimeter against the inwardly-extending member and the inside surface, in position to contact the ridge surface when the door is closed.

13. The floodlight of claim 1 wherein the edge which forms the opening in the housing is planar and the outside surface of the access door is recessed with respect to the access opening when the door is closed.

14. The floodlight of claim 13 wherein the articulated hinges each comprise:

a housing bracket secured to the interior surface of the first side portion and having a first pivot attachment means at said first pivot point;

a door bracket secured to the inside surface of the door and having a second pivot attachment means at said second pivot point; and said linkage means comprising a link member having separate pivot attachments to the first and second pivot attachment means, the second pivot attachment means, when the door is closed, being offset from the first in a direction away from and normal to the door whereby the link member holds the door firmly against the housing.

15. The floodlight of claim 14 wherein the door bracket is a rigid generally L-shaped member such that, when the door is in closed position, the L-shaped member has a first portion extending away from the door and a second portion extending toward the interior surface and having a distal end including the second pivot attachment means.

16. The floodlight of claim 15 further comprising resilient seal means located, when the door is closed, between the perimeter of the door and the interior surface near the edge, the second pivot attachment means being offset from the first by a distance such that the link member holds the door in position against the seal deforming the seal to obtain an improved watertight closure.

17. The floodlight of claim 16 wherein the interior surface has a outwardly-facing ridge surface thereabout near the edge and the inside surface of the door has an inwardly-extending member near the perimeter, the resilient seal means comprising a ring seal extending along the perimeter against the inwardly-extending member and the inside surface, in position to contact the ridge surface when the door is closed.

* * * * *